US008029914B2

(12) United States Patent
Bagnoli et al.

(10) Patent No.: US 8,029,914 B2
(45) Date of Patent: Oct. 4, 2011

(54) HIGH PERFORMANCE COATED MATERIAL WITH IMPROVED METAL DUSTING CORROSION RESISTANCE

(75) Inventors: Kenneth E. Bagnoli, Fairfax, VA (US); G. Phillip Anderson, Chicago, IL (US); Trikur A. Ramanarayanan, Somerset, NJ (US); ChangMin Chun, Belle Mead, NJ (US)

(73) Assignee: ExxonMobile Research and Engineering Company, Annandale, NJ (US)

( * ) Notice: Subject to any disclaimer, the term of this patent is extended or adjusted under 35 U.S.C. 154(b) by 623 days.

(21) Appl. No.: 11/827,013

(22) Filed: Jul. 10, 2007

(65) Prior Publication Data

US 2008/0020216 A1 Jan. 24, 2008

Related U.S. Application Data

(63) Continuation-in-part of application No. 11/126,007, filed on May 10, 2005, now Pat. No. 7,354,660.

(60) Provisional application No. 60/831,696, filed on Jul. 18, 2006.

(51) Int. Cl.

| | |
|---|---|
| ***B32B 15/04*** | (2006.01) |
| ***B32B 15/20*** | (2006.01) |
| ***B05D 3/02*** | (2006.01) |
| ***B05D 3/06*** | (2006.01) |

(52) U.S. Cl. ..... 428/629; 428/680; 428/633; 428/215; 428/332; 428/334; 428/336; 427/576; 427/585; 427/405; 427/419.2; 427/453; 427/455; 427/456; 422/241

(58) Field of Classification Search ..... 428/469, 428/680, 650, 628, 629, 630, 631, 633, 634, 428/651, 652, 653, 678, 681, 684, 685, 613, 213, 215, 220, 335, 336, 332, 334
See application file for complete search history.

(56) References Cited

U.S. PATENT DOCUMENTS 6,153,313 A 11/2000 Rigney et al.
(Continued)

OTHER PUBLICATIONS

Helmenstine, "What is the Chemical Composition of Air?" (no date) downloaded from http://chemistry.about.com/od/chemistryfaqs/f/aircomposition.htm on Jan. 31, 2010.*

*Primary Examiner* — Michael Lavilla
(74) *Attorney, Agent, or Firm* — Robert A. Migliorini

(57) ABSTRACT

High performance coated metal compositions resistant to metal dusting corrosion and methods of providing such compositions are provided by the present invention. The coated metal compositions are represented by the structure (PQR), wherein P is an oxide layer at the surface of (PQR), Q is a coating metal layer interposed between P and R, and R is a base metal. P includes alumina, chromia, silica, mullite or mixtures thereof. Q includes Ni and Al, and at least one element selected from the group consisting of Cr, Si, Mn, Fe, Co, B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au and mixtures thereof. R is selected from the group consisting of carbon steels, low chromium steels, ferritic stainless steels, austenetic stainless steels, duplex stainless steels, Inconel alloys, Incoloy alloys, Fe—Ni based alloys, Ni-based alloys and Co-based alloys. Advantages exhibited by the disclosed coated metal compositions include improved metal dusting corrosion resistance at high temperatures in carbon-supersaturated environments having relatively low oxygen partial pressures. The coated metal compositions are suitable for use in syngas generation process equipment.

23 Claims, 11 Drawing Sheets

EDXS Line Profile of a NiAl-Coated Material After Testing At 1050°C In 50CO-50$H_2$ Gas Mixture For 300 Hours

U.S. PATENT DOCUMENTS 6,475,647 B1 * 11/2002 Mendez Acevedo et al. . 428/678
6,623,869 B1 9/2003 Nishiyama et al.
6,692,838 B2 2/2004 Ramanarayanan et al.
6,737,175 B2 5/2004 Ramanarayanan et al.
6,737,556 B2 5/2004 Jones et al.
2004/0199037 A1 * 10/2004 Kobayashi et al. ..... 585/502
2004/0211569 A1 10/2004 Vinegar et al.
2005/0079378 A1 4/2005 Lundberg et al.
2006/0257657 A1 11/2006 Curran et al.

* cited by examiner

High Performance Coated Material Used For Protecting Syngas Generation Process Equipment At Various Locations Of The Tubing Or Piping Mass Gain Due To Carbon Deposition on Linde B Finished Alloys After Reaction At 650°C In 50CO-50$H_2$ Gas Mixture For 160 Hours SEM of the Corrosion Surface of an Uncoated Inconel 601 Alloy After Reaction At 650°C In 50CO-50$H_2$ Gas Mixture For 160 Hours SEM of the Corrosion Surface of an Uncoated Inconel 693 Alloy After Reaction At 650°C In 50CO-50$H_2$ Gas Mixture For 160 Hours EDXS Line Profile of a NiAl-Coated Material After Testing At 1050°C In 50CO-50$H_2$ Gas Mixture For 300 Hours Surface And Cross-Sectional SEM Image of the NiAl-Coated Inconel 601 Material After Testing At 1050°C In 50CO-50$H_2$ Gas Mixture For 300 Hours EDXS Line Profile of a NiCrAl-Coated Inconel 601 Material Near the Coated Surface Before Testing at 1050°C In 50CO-50$H_2$ Gas Mixture For 300 Hours Surface and Cross-Sectional Image of the NiCrAl-Coated Inconel 601 Material Near The Coated Surface After Testing At 1050°C In 50CO-50$H_2$ Gas Mixture For 300 Hours EDXS Line Profile of a NiCrAl coated 35/45 Alloy Near the Coated Surface Before Testing At 1050°C In 50CO-50$H_2$ Gas Mixture For 300 Hours Surface And Cross-Sectional Image Of The NiCrAl-Coated 35/45 Alloy Near The Coated Surface After Testing At 1050°C In 50CO-50$H_2$ Gas Mixture For 300 Hours Surface And Cross-Sectional SEM Image of the NiCrAlY-Coated Inconel 601 Material After Testing At 650°C In 50CO-50$H_2$ Gas Mixture For 160 Hours

HIGH PERFORMANCE COATED MATERIAL WITH IMPROVED METAL DUSTING CORROSION RESISTANCE

CROSS-REFERENCE TO RELATED APPLICATION

This application claims priority of U.S. Provisional Application Ser. No. 60/831,696 filed Jul. 18, 2006, and is a Continuation-in Part of U.S. Ser. No. 11/126,007 filed May 10, 2005 now U.S. Pat. No. 7,354,660.

FIELD OF THE INVENTION

The present invention relates to the field of materials used in syngas generation processes. It more particularly relates to materials exposed to corrosive reactants and carbon supersaturated environments. Still more particularly, the present invention relates to a coated material compositions and methods for controlling metal dusting corrosion in reactor systems, gas/gas heat exchanger systems, and syngas process tubing and piping apparatus exposed to high carbon activities and relatively low oxygen activities.

BACKGROUND OF THE INVENTION

One of the most abundant fossil fuels is natural gas, which is principally methane. In high temperature processes involving the conversion of methane to high value products such as liquid hydrocarbons, chemicals, such as ethylene, or the generation of electric power, environmental conditions are often encountered involving very high carbon activities and relatively low oxygen activities. Similar environments can also be encountered in many other syngas generation processes. In many syngas generation processes, for example the conversion of methane to syngas, coke to syngas, coal to syngas, heavy oils and bitumen to syngas, environments are encountered that have high carbon activities and relatively low oxygen activities. High temperature reactor materials, heat exchanger materials, and syngas process tubing and piping materials used in such processes can deteriorate in service by a very aggressive form of corrosion known as metal dusting. Metal Dusting is a deleterious form of high temperature corrosion experienced by Fe, Ni and Co-based alloys at temperatures in the range of 350-1050° C. in carbon-supersaturated (carbon activity>1) environments having relatively low (about $10^{-10}$ to about $10^{-20}$ atmospheres) oxygen partial pressures. This form of corrosion is characterized by the disintegration of bulk metal into powder or dust. Most alloys that are commercially available today degrade by this corrosion process.

Although many high temperature alloys are designed to form in-situ surface film of chromium oxide ($Cr_2O_3$) in low oxygen partial pressure environments, chromium oxide reacts at high temperatures (i.e. >1000° C.) in the presence of oxygen to form $CrO_3$, which is a vapor and evaporates to result in a chromium-depleted alloy. The chromium depleted alloys are unable to form a protective chromium oxide film, thus carbon ingresses into the alloy from highly reducing carbon-rich environments with carbon activities in excess of unity. This results in metal dusting corrosion.

Aluminum and silicon are strong oxide formers and can be added to high temperature alloys to improve corrosion resistance by forming an in-situ surface film of aluminum oxide and silicon oxide. However, an excess addition of these elements, which is desired for superior corrosion resistance, generally leads to poor mechanical strength at elevated temperatures at which the alloys are used. Thus, alloys containing an excessive amount of aluminum and silicon can not be used in constructing components in syngas generation processes.

Methodologies disclosed in the literature for controlling metal dusting corrosion involve the use of gaseous inhibitors, for example $H_2S$. Inhibition by $H_2S$ has two disadvantages. One is that $H_2S$ tends to poison most catalysts used in hydrocarbon conversion processes. Secondly, $H_2S$ has to be removed from the exit stream which can substantially add to process costs.

U.S. Pat. No. 6,692,838 to Ramanarayanan et al. discloses compositions resistant to metal dusting and a method for preventing metal dusting on metal surfaces exposed to carbon supersaturated environments. The compositions comprise (a) an alloy, and (b) a protective oxide coating on the alloy. The alloy includes alloying metals and base metals, wherein the alloying metals comprise a mixture of chromium manganese, and the base metal comprises iron, nickel, and cobalt. U.S. Pat. No. 6,692,838 is incorporated herein by reference in its entirety.

U.S. Pat. No. 6,737,175 to Ramanarayanan et al. discloses an alloy composition resistant to metal dusting and a method for inhibiting metal dusting corrosion of metal surfaces exposed to supersaturated carbon environments. The method includes constructing the surfaces of, or coating the surfaces with a copper based alloy. U.S. Pat. No. 6,737,175 is incorporated herein by reference in its entirety.

U.S. patent application Ser. No. 11/126,007 filed on May 10, 2005 to Chun et al. also discloses alloy compositions and methods for preventing metal dusting on metal surfaces exposed to carbon supersaturated environments. The alloy compositions include an alloy (PQR), and a multi-layer (at least three layers) oxide film on the surface of the alloy (PQR) wherein the alloy (PQR) includes a metal (P) selected from the group consisting of Fe, Ni, Co, and mixtures thereof, an alloying metal (Q) comprising Cr, Mn, and either Al, Si, or Al/Si, and an alloying element (R). The multi-layer oxide film is formed in-situ during use of the alloy composition in a carbon supersaturated metal dusting environment. U.S. patent application Ser. No. 11/126,007 is incorporated herein by reference in its entirety.

There is a need for new alloys and coating materials, which are resistant to metal dusting corrosion. More particularly, a need exists for an advanced coated material composition, wherein the coated metal is resistant to metal dusting corrosion in low (about $10^{-10}$ to about $10^{-20}$ atmospheres) oxygen partial pressure and carbon-supersaturated (carbon activity>1) environments and includes a base metal providing the coated material with the required high temperature strength and other properties, such as creep strength and toughness. Such an advanced coated material composition should be capable of forming an outer protective oxide layer to block carbon transfer by acting as a diffusion barrier to carbon ingress.

SUMMARY OF THE INVENTION

According to the present disclosure, an advantageous high performance coated material composition resistant to metal dusting corrosion comprises: (PQR), wherein P is an oxide layer at the surface of (PQR), Q is a coating metal layer interposed between P and R, and R is a base metal layer, wherein P comprises alumina, chromia, silica, mullite or mixtures thereof, Q comprises Ni and Al, and at least one element selected from the group consisting of Cr, Si, Mn, Fe, Co, B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au and mixtures thereof, and R is selected from the group consisting of carbon steels, low chromium steels, ferritic stainless steels, austenetic stainless steels, duplex stainless steels, Inconel alloys, Incoloy alloys, Fe—Ni based alloys, Ni-based alloys and Co-based alloys.

A further aspect of the present disclosure relates to an advantageous method of preventing metal dusting corrosion of metal surfaces exposed to carbon supersaturated environments comprising a high performance coated metal composition (PQR), wherein P is an oxide layer at the surface of (PQR), Q is a coating metal layer interposed between P and R, and R is a base metal, wherein P comprises alumina, chromia, silica, mullite or mixtures thereof, Q comprises Ni and Al, and at least one element selected from the group consisting of Cr, Si, Mn, Fe, Co, B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au and mixtures thereof, and R is selected from the group consisting of carbon steels, low chromium steels, ferritic stainless steels, austenetic stainless steels, duplex stainless steels, Inconel alloys, Incoloy alloys, Fe—Ni based alloys, Ni-based alloys and Co-based alloys; wherein the method comprises the step of providing the metal surfaces with (PQR).

Numerous advantages result from the advantageous high performance coated material composition comprising (PQR), wherein P is an oxide layer at the surface of (PQR), Q is a coating metal layer located between P and R, and R is a base metal layer disclosed herein and the uses/applications therefore.

For example, in exemplary embodiments of the present disclosure, the high performance coated material composition comprising (PQR) exhibits improved metal dusting corrosion resistance at high temperatures in carbon-supersaturated environments having relatively low oxygen partial pressures.

In a further exemplary embodiment of the present disclosure, the high performance coated material composition comprising (PQR) exhibits the capability of forming a thermodynamically stable, slowly growing, adherent inert oxide film to act as a diffusion barrier to carbon ingress.

In a further exemplary embodiment of the present disclosure, the high performance coated material composition comprising (PQR) does not poison most catalysts used in hydrocarbon conversion processes.

In a further exemplary embodiment of the present disclosure, the high performance coated material composition comprising (PQR) yields improved adhesion of the surface oxide film or layer, which enhances spalling resistance.

In a further exemplary embodiment of the present disclosure, the high performance coated material composition comprising (PQR) yields reduced carbon deposition in carbon supersaturated environments.

In a further exemplary embodiment of the present disclosure, the oxide layer (P) on the surface of the high performance coated material composition comprising (PQR) forms when it is exposed to metal dusting environments with low oxygen partial pressures.

In a further exemplary embodiment of the present disclosure, the oxide layer (P) on the surface of the high performance coated material composition comprising (PQR) forms in-situ during use of the alloy in a carbon supersaturated environment.

In a further exemplary embodiment of the present disclosure, the oxide layer (P) on the surface of the high performance coated material composition comprising (PQR) forms prior to use by exposing the alloy to a carbon supersaturated a low oxygen partial pressure environment or to controlled low oxygen partial pressure environments.

In a further exemplary embodiment of the present disclosure, the coating metal layer (Q) on the surface of the high performance coated material composition comprising (PQR) has a low porosity.

Another advantage of the high performance coated material composition comprising (PQR) is that if the protective surface oxide layer (P) cracks during use of the composition in a carbon supersaturated environment, the protective surface oxide layer (P) will reform in the crack to repair the oxide layer thereby protecting the alloy from metal dusting during use.

The disclosed high performance coated material compositions comprising (PQR) have application in syngas process equipment that are in contact with carbon supersaturated environments at any time during use, including reactors, gas/gas heat exchangers and syngas generation process tubing and piping.

The disclosed high performance coated material compositions comprising (PQR) may be provided to the surface for protection by: 1) constructing the apparatus from (PQR), 2) coextruding Q and R to form the surface of the apparatus, or 3) coating Q onto R to form the surface of the apparatus exposed to metal dusting environments.

These and other advantages, features and attributes of the present disclosure and the high performance coated material compositions comprising (PQR) and their advantageous applications and/or uses will be apparent from the detailed description which follows, particularly when read in conjunction with the figures appended hereto.

BRIEF DESCRIPTION OF THE DRAWINGS

To assist those of ordinary skill in the relevant art in making and using the subject matter hereof, reference is made to the appended drawings, wherein.

DETAILED DESCRIPTION OF THE INVENTION

Figure 1:
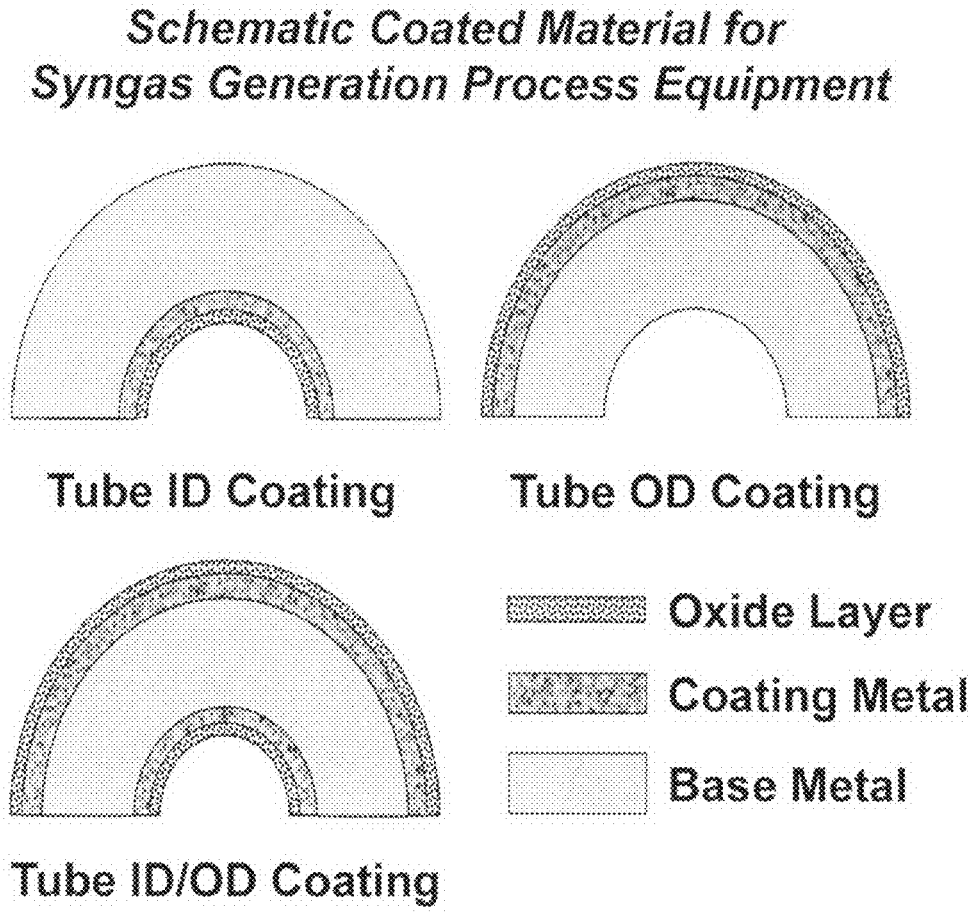
FIG. 1 depicts a schematic illustration of the high performance coated material of the present invention used for protecting syngas generation process equipment at various locations of the tubing or piping.

The present invention relates to a high performance coated material capable of forming a stable aluminum oxide surface film. The high performance coated material composition resistant to metal dusting corrosion of the present invention are distinguishable from the prior art in comprising a surface oxide layer, a coating metal located on one side of the surface oxide layer, and a base metal located on the side of the coating metal opposite that of the oxide layer. More particularly, the coating metal of the present invention is distinguishable from the prior art in yielding improved adhesion of the surface oxide film or layer, which enhances spalling resistance. The coating metal of the present invention is also distinguishable from the prior art in yielding improved adhesion of the base metal, which improves the coating integrity. In addition, the coating metal of the present invention yields reduced carbon deposition in carbon supersaturated environments with respect to the prior art.

The high performance coated material composition of the present invention offers significant advantages relative to prior art alloy compositions for use as protective coatings to metal dusting on metal surfaces exposed to carbon supersaturated environments. The advantageous properties and/or characteristics of the disclosed high performance coated alloy compositions are based, at least in part, on the structure of the aluminum oxide film formed on the surface of the coating metal, which include, inter alia, improved metal dusting corrosion resistance, decreased carbon deposition, decreased propensity to poison catalysts used in hydrocarbon conversion processes, improved adhesion of in-situ formed surface oxide films, improved spalling resistance, improved ease of formation prior to and in use when exposed to a carbon supersaturated environment.

The high performance coated material composition resistant to metal dusting corrosion of the present invention is represented by the formula (PQR). P is an oxide layer comprising alumina, chromia, silica, mullite, and mixtures thereof. P forms the outer surface layer of the high performance coated material composition, and therefore the layer that is directly in contact with carbon supersaturated and low oxygen partial pressure environment. Located adjacent to the oxide layer P is a coating metal, Q comprising Ni and Al, and at least one element selected from the group consisting of Cr, Si, Mn, Fe, Co, B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au, and mixtures thereof. Located on the opposite side of the coating metal layer Q is a base metal R selected from the group consisting of carbon steels, low chromium steels, ferritic stainless steels, austenetic stainless steels, duplex stainless steels, Inconel alloys, Incoloy alloys, Fe—Ni based alloys, Ni-based alloys and Co-based alloys.

Outer Oxide Layer (P)

The oxide layer, P, on the surface of the coating metal, Q, forms in-situ during use of the coated material in a carbon supersaturated environment. Alternatively, an oxide layer, P, on the surface of a coating metal, Q, forms prior to use by exposing the coated material to a carbon supersaturated and a low oxygen partial pressure environments. Alternatively, an oxide layer, P, on the surface of a coating metal, Q, forms prior to use by exposing the coated material to controlled low oxygen partial pressure environments.

The oxide layer, P, is an oxide layer comprising alumina, chromia, silica, mullite, and mixtures thereof and may contain some impurity oxides formed from the element constituting a coating metal, Q, and a base metal, R. A preferred oxide layer, P, is alumina. The thickness of an oxide layer, P, ranges from at least about 1 nm to about 100 μm, preferably from at least about 10 nm to about 50 μm, more preferably from at least about 100 nm to about 10 μm.

The oxide layer, P, on the surface of the coating metal, Q, described herein is formed on the coating metal surface by exposing the coated material to a metal dusting environment. A non-limiting example of a metal dusting environment is a gaseous 50CO:50$H_2$ mixture. The metal dusting environment may further contains other gases such as $CH_4$, $NH_3$, $N_2$, $O_2$, He, Ar and hydrocarbons and enable to form a stable oxide layer, P, comprising alumina, chromia, silica, mullite, and mixtures thereof on the coating metal, Q. Therefore, the protective oxide layer may be formed during use or prior to use of the alloys under reaction conditions similar to that to which it is exposed to in a metal dusting environment. The preferred temperature range of the metal dusting environment is from about 350° C. to about 1200° C., preferably from about 550° C. to about 1200° C. Typical exposure times range from about 1 hour to about 500 hours, preferably from about 1 hour to about 300 hours, and more preferably from about 1 hour to about 100 hours.

The oxide layer, P, on the surface of the coating metal, Q, described herein may also be formed on the coating metal surface by exposing the coated material to controlled low oxygen partial pressure environments. Non-limiting examples of a controlled low oxygen partial pressure environment is a gaseous $H_2O$:$H_2$ mixture and a gaseous $CO_2$:CO mixture. The controlled low oxygen partial pressure environment may further contain other gases such as $CH_4$, $NH_3$, $N_2$, $O_2$, He, Ar and hydrocarbons and enable to form a stable oxide layer, P, comprising alumina, chromia, silica, mullite, and mixtures thereof on the coating metal, Q. Therefore, the protective oxide layer is formed prior to use of the alloys in metal dusting environments. The preferred temperature range of the controlled low oxygen partial pressure environment is from about 350° C. to about 1200° C., preferably from about 550° C. to about 1200° C. Typical exposure times range from about 1 hour to about 500 hours, preferably from about 1 hour to about 300 hours, and more preferably from about 1 hour to about 100 hours.

Coating Metal Layer (Q)

The coating metal, Q, includes a mixture of Ni and Al, and at least one element selected from the group consisting of Cr, Si, Mn, Fe, Co, B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au, and mixtures thereof. The coating metal compositions of the present disclosure offer significant advantages relative to prior art alloy compositions for use as protective coatings to metal dusting on metal surfaces exposed to carbon supersaturated environments. As a non-limiting example, alloying elements such as Sc, La, Y and Ce, provide improved adhesion of in-situ formed surface oxide films, which contributes to enhance spalling resistance. Alloying elements such as Ga, Ge, As, In, Sn, Sb, Pb, Pd, Pt, Cu, Ag and Au, provide reduced carbon deposition because these elements are non-catalytic to surface carbon transfer reaction.

The coating metal layer, Q, comprises about 4 wt. % to about 70 wt. % aluminum, preferably about 4 wt. % to about 50 wt. % aluminum, and more preferably about 4 wt. % to about 30 wt. % aluminum. In a preferred embodiment, the coating metal layer, Q, includes a smaller amount of Fe in the coating metal, Q, than in the base metal, R. The coating metal, Q, comprises less than about 12 wt. % Fe, preferably less than about 10 wt. % Fe, and more preferably less than about 8 wt. % Fe. Coating metals, Q which include much greater than 12 wt. % Fe results in poor metal dusting corrosion resistance in a carbon supersaturated and a low oxygen partial pressure environments. Ni as a component to the coating metal layer also decreases the dusting corrosion rate as it is about one order magnitude lower in dusting corrosion rate than pure Fe.

The coating metal of the present invention has a low porosity which contributes to its improved resistance to carbon deposition in carbon supersaturated environments. The coating metal layer, Q, comprises less than about 8 vol. % porosity, preferably less than about 3 vol. % porosity, more preferably less than about 2 vol. % porosity, and even more preferably less than 1 vol. % porosity. Excessive amount of porosity in the coating metal layer serves as a pathway for corrosive gases in metal dusting environments to transfer to the coating metal and to the base metal surface. The carbon transfer triggers carbon precipitation in the coating metal layer and delamination of the coating metal at the coating/base metal interface. Thus it is advantageous to achieve a coating metal layer containing a minimal amount of porosity.

The low porosity coating metal layer can be established by a coating method such as CVD, MOCVD, PVD, slurry coating, pack cementation, weld overlay and plasma powder welding. The coating metal layer may be post-annealed or laser melted to achieve a higher density coating. In contrast, the conventional thermal spray coating processes such as plasma, HVOF and detonation gun generally yield the coating metal layer that is of a higher porosity. The conventional thermal spray coating is produced by a process in which molten or softened particles are applied by impact onto a substrate. The coating often contains lenticular or lamellar grain structure resulting from the rapid solidification of small globules, flattened from striking a cold surface at high velocities. It is virtually impossible to ensure that all particles are the exact same size and achieve the same temperature and velocity. Thus, variations in the conditions of the individual particles on impact during thermal spray process lead to heterogeneous structure of the cermet layer, which includes excessive porosity.

Two preferred embodiments of the high performance coated material compositions of the present invention include a coating metal, Q, comprising either: (1) Ni and Al, or (2) Ni, Al and Cr. The coated metal composition, NiAl, is an intermetallic phase known as beta phase. The β-NiAl coating may be applied to a base metal, R, by methods such as CVD, MOCVD, PVD, slurry coating and pack cementation. The thickness of β-NiAl ranges from about 1 to about 300 μm, preferably from about 1 to about 200 μm, and more preferably from about 1 to about 100 μm. The coated metal composition, NiAl, comprises about 17 wt. % to about 39 wt. % Al, and about 61 wt. % to about 83 wt. % Ni. Preferably, coated metal composition, NiAl, comprises about 18 wt. % Al, and about 82 wt. % Ni. The coated metal composition, NiCrAl, may be applied to a base metal, R, by weld overlay methods such as plasma powder welding. The thickness of NiCrAl ranges from about 100 μm to about 5 mm, preferably from about 100 μm to about 4 mm, more preferably from about 100 μm to about 3 mm. The coated metal composition, NiCrAl, comprises about 4 wt. % to about 10 wt. % Al, about 15 wt. % to about 30 wt. % Cr, and about 60 wt. % to about 81 wt. % Ni. Preferably, the coated metal, Q, comprises about 6 wt. % Al, about 25 wt. % Cr, and about 69 wt. % Ni.

Base Metal (R)

The base metal, R, is selected from the group consisting of carbon steels, low chromium steels, ferritic stainless steels, austenetic stainless steels, duplex stainless steels, Inconel alloys, Incoloy alloys, Fe—Ni based alloys, Ni-based alloys and Co-based alloys. The base metal, R, may also be any commercially available alloy to be used for constructing syngas generation process equipments. A non-limiting list of base metals, R, for use in the present invention is presented in Table 1. These base metals are suitable for making advantageous high performance coated materials (PQR) resistant to metal dusting corrosion.

TABLE 1

| Base Metal, R | Alloy | UNS No. | Alloy Compositions (Weight %) |
|---|---|---|---|
| Carbon steels | 1018 | G10180 | Bal. Fe, 0.6-0.9Mn, 0.14-0.20C |
| | 4130 | G41300 | Bal. Fe, 0.35-0.60Mn, 0.80-1.15Cr, 0.27-0.34C |
| Low chromium steels | T11 | K11562 | Bal. Fe: 1.25Cr: 0.5Mo, 0.5Si, 0.3Mn, 0.15C, 0.045P, 0.045S |
| | T22 | K21590 | Bal. Fe: 2.25Cr: 1.0Mo, 0.5Si, 0.3Mn, 0.15C, 0.035P, 0.035S |
| | T5 | S50100 | Bal. Fe: 5Cr: 0.5Mo, 0.5Si, 0.3Mn, 0.15C, 0.04P, 0.03S |
| | T9 | J82090 | Bal. Fe: 9Cr: 1.0Si, 0.35Mn, 0.02C, 0.04P, 0.045S |
| Ferritic stainless steels | 409 | S40900 | Bal. Fe: 10.5Cr: 1.0Si, 1.0Mn, 0.5Ni, 0.5Ti, 0.08C, 0.045P, 0.045S |
| | 410 | S41000 | Bal. Fe: 11.5Cr: 0.15C, 0.045P, 0.03S |
| | 430 | S43000 | Bal. Fe: 16.0Cr: 1.0Si, 1.0Mn, 0.12C, 0.045P, 0.03S |
| Austenetic stainless steels | 304 | S30400 | Bal. Fe: 8Ni: 18Cr: 2.0Mn, 0.75Si, 0.08C, 0.04P, 0.03S |
| | 310 | S31000 | Bal. Fe: 19Ni: 24Cr: 2.0Mn, 1.5Si, 0.75Mo, 0.25C, 0.045P, 0.03S |
| | 253MA | S30815 | Bal. Fe: 11Ni: 21Cr: 1.7Si, 0.04Ce, 0.17N, 0.08C |
| | RA85H | S30615 | Bal. Fe: 14.5Ni: 18.5Cr: 3.5Si: 1.0Al, 0.2C |
| Duplex stainless steels | 2205 | S32205 | Bal. Fe: 4.5Ni: 22Cr: 2.0Mn, 1.0Si, 3.0Mo, 0.03C, 0.14N, 0.03P, 0.02S |

TABLE 1-continued

| Base Metal, R | Alloy | UNS No. | Alloy Compositions (Weight %) |
|---|---|---|---|
| | 2507 | S32507 | Bal. Fe: 6Ni: 24Cr: 1.2Mn, 0.8Si, 3.0Mo, 0.5Cu, 0.03C, 0.2N, 0.035P, 0.02S |
| Inconel alloys | Inconel 600 | N06600 | Bal. Ni: 8.0Fe: 25.5Cr, 0.08 |
| | Inconel 601 | N06601 | Bal. Ni: 14.4Fe: 23.0Cr: 0.3Mn: 1.4Al, 0.5Si, 0.1C |
| | Inconel 602CA | N/A | Bal. Ni: 9.5Fe: 25.0Cr: 2.2Al, 0.18C |
| | Inconel 690 | N06690 | Bal. Ni: 9.0Fe: 29.0Cr: 0.3Mn: 1.4Al, 0.5Si, 0.1C |
| | Inconel 693 | N06693 | Bal. Ni: 4.0Fe: 29.0Cr: 3.1Al |
| | Inconel MA754 | N/A | Bal. Ni: 9.0Fe: 29.0Cr: 0.3Mn: 1.4Al, 0.5Si, 0.1C |
| Incoloy alloys | Incoloy 800H | N08810 | Bal. Fe: 33.0Ni: 21.0Cr: 0.8Mn: 0.5Al: 0.4Si: 0.5Ti: 0.07C |
| | Incoloy 825 | N08825 | Bal. Ni: 30.0Fe: 21.5Cr: 3.0Mo: 2.2Cu: 0.03C |
| Fe—Ni based alloys | KHR-45A (35/45 Alloy) | N/A | Bal. Fe: 43.6Ni: 32.1Cr: 1.0Mn: 1.7Si: 0.9Nb: 0.1Ti: 0.4C |
| Ni-based alloys | Haynes 214 | N07214 | Bal. Ni: 3.0Fe: 2.0Co: 16.0Cr: 0.5Mn: 4.5Al: 0.2Si: 0.5Mo: 0.5Ti: 0.05C |
| Co-based alloys | Haynes 188 | R30188 | Bal. Co: 22.0Ni: 22.0Cr: 3.0Fe: 14.0W: 0.04La: 0.1C |
| | MP35N | R30035 | Bal. Co: 35.0Ni: 20.0Cr: 10.0Mo |

Method of Forming and Applications of High Performance Coated Compositions

A method for preventing metal dusting of metal surfaces exposed to carbon supersaturated environments is also disclosed in the present invention. The method entails providing a metal surface with a high performance coated material composition, wherein the material composition comprises: (PQR), wherein P is an oxide layer at the surface of (PQR), Q is a coating metal layer located between P and R, and R is a base metal layer, wherein P comprises alumina, chromia, silica, mullite or mixtures thereof, Q comprises Ni and Al, and at least one element selected from the group consisting of Cr, Si, Mn, Fe, Co, B, C, N, P, Ga, Ge, As, In, Sn, Sb, Pb, Sc, La, Y, Ce, Ti, Zr, Hf, V, Nb, Ta, Mo, W, Ru, Rh, Ir, Pd, Pt, Cu, Ag, Au and mixtures thereof, and R is selected from the group consisting of carbon steels, low chromium steels, ferritic stainless steels, austenetic stainless steels, duplex stainless steels, Inconel alloys, Incoloy alloys, Fe—Ni based alloys, Ni-based alloys and Co-based alloys.

Metal surfaces to be protected in carbon-supersaturated (carbon activity>1) environments having relatively low (about $10^{-10}$ to about $10^{-20}$ atmospheres) oxygen partial pressures at temperatures in the range of 350-1050° C. may be constructed of the high performance coated material, coextruded with the coated material, coated with the coated material, or a combination of the three. In one embodiment for providing the high performance coated material compositions (PQR) of the present invention, the composition may be formed by constructing the process apparatus out of a coating metal layer, Q, and base metal layer, R. In another embodiment for providing the high performance coated material composition (PQR) of the present invention, the composition may be formed by coextruding a coating metal layer, Q, and a base metal layer, R, using steel coextrusion techniques known to one skilled in the art. In yet another embodiment for providing the high performance coated material composition (PQR) of the present invention, the composition may be formed from the existing surfaces of process apparatus susceptible to metal dusting that are fabricated from a base metal, R, by coating the surface with a coating metal, Q, of the instant invention using coating techniques known to one skilled in the art. Exemplary coating techniques suitable for coating base metals, R, with the coating metal compositions described herein include, but are not limited to, CVD, MOCVD, PVD, slurry coating, pack cementation, plasma powder welding, thermal spraying and sputtering. Hence the high performance coated material compositions (PQR) of the present invention may be either constructed of, coextruded with, or coated with the high performance coated material compositions described herein.

The protective surface oxide layer, P, described above may be formed in-situ during operation of the unit in a carbon supersaturated environment. More specifically, the protective surface oxide layer, P, for each of the three methods for forming a coated metal and base metal combination (QR) may be formed during the use of the apparatus when exposed to metal dusting environments (in-situ formation). Alternatively, the protective surface oxide layer, P, described above may be formed prior to use of the apparatus by exposure of the coated metal and base metal combination (QR) to a carbon supersaturated environment. One exemplary, but non-limiting, metal dusting environment is exposing the high performance coated material of the present invention to a metal dusting environment, such as a $50CO:50H_2$ mixture. Alternatively, the protective surface oxide layer, P, described above may be formed prior to use of the apparatus by exposure of the coated metal and base metal combination (QR) to a controlled low oxygen partial pressure environment. Non-limiting examples of a controlled low oxygen partial pressure environment are exposing the high performance coated material of the present invention to a gaseous $H_2O:H_2$ mixture or a gaseous $CO_2:CO$ mixture. The preferred temperature range is from about 350° C. to about 1200° C., preferably from about 550° C. to about 1200° C. Typical exposure times can range from about 1 hour to about 300 hours, preferably from about 1 hour to about 100 hours. Therefore, the protective oxide coating layer, P, may be formed during use or prior to use of the alloys under reaction conditions in which they are exposed to metal dusting environments.

The high performance coated material compositions (PQR) of the present invention described herein may be utilized to construct the surface of apparatus exposed to metal dusting environments. FIG. 1 schematically illustrates the use of the coated material (PQR) for syngas generation process equipment. As a non-limiting example, syngas process tubing or piping may be coated on inside diameter, outside diameter or both the inside and outside diameter depending upon the need for metal dusting corrosion resistance. Surfaces of syngas process equipment which would benefit from the high performance coated material of the instant invention include apparatus and reactor systems that are in contact with carbon supersaturated environments at any time during use. These apparatus and reactor systems include, but are not limited to, reactors, gas/gas heat exchangers, and syngas generation process tubing and piping.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

The following examples illustrate the present invention and the advantages thereto without limiting the scope thereof.

Test Methods

The determination of weight percent of elements in the coated material (PQR) was determined by standard Energy Dispersive X-ray Spectroscopy (EDXS) analyses. For commercially available alloys (Inconel 601 and Inconel 693), rectangular samples of 0.5 inch×0.25 inch×0.06 inch were prepared from the alloy sheets. The β-NiAl-coated Inconel 601 sample was prepared by a pack cementation method. A base metal, Inconel 601, was subject to chromizing prior to aluminizing pack cementation process. Diffusion reaction was carried out at about 800° C. to form δ-$Ni_2Al_3$ phase on the base metal, Inconel 601, surfaces. Subsequent heat treatment was carried out at 1079° C. to convert the low melting δ phase to β-NiAl phase, wherein Al content ranges from about 17 to about 39 wt. %. The NiCrAl-coated Inconel 601 and the NiCrAl coated alloy 35/45 samples were prepared by a plasma powder welding method. As a comparative example, the NiCrAl-coated Inconel 601 sample was prepared by an air plasma spray, a conventional thermal spray method. Rectangular specimen of 0.5 inch×0.25 inch was cut from the sample. The specimen faces were polished to 600 grit finish or Linde B (0.05 micrometers alumina powder) finish and cleaned in acetone. The corrosion kinetics of various alloy specimens were investigated by exposing the specimens to a 50CO-50$H_2$ (vol. %) environment for up to 300 hours at test temperatures ranging from 550° C. to 1050° C. A Cahn 1000 electrobalance was used to measure the carbon pick up of the specimen. Carbon pick up is an indication of metal dusting corrosion. Both surface and cross section of the specimen also were examined using a Scanning Electron Microscopy (SEM).

EXAMPLES

Example 1

Figure 2:
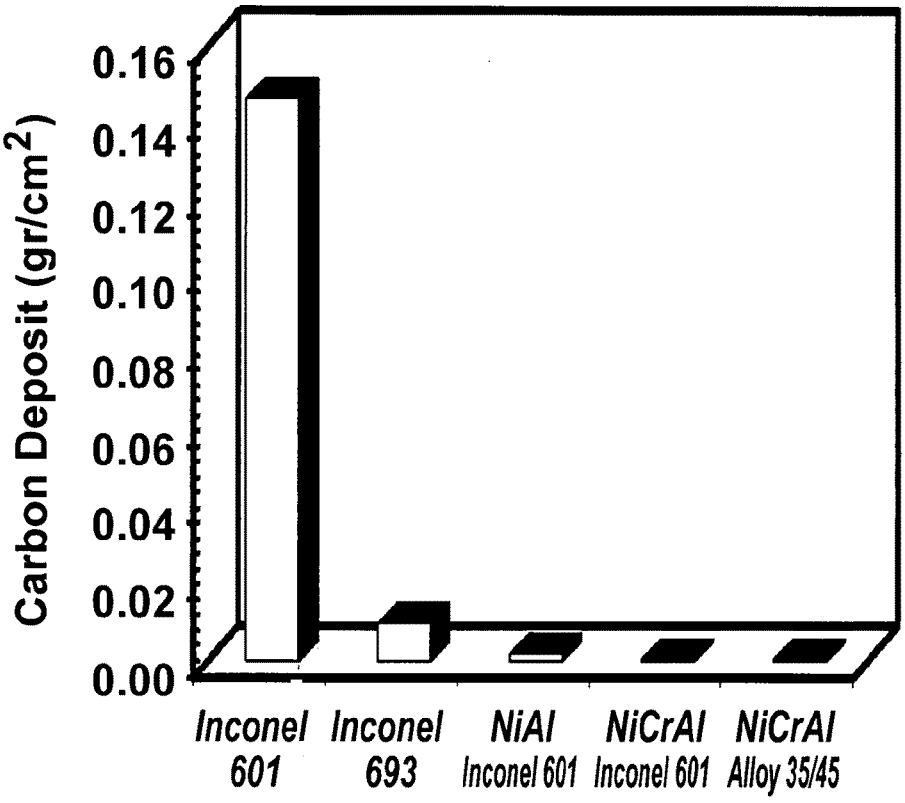
FIG. 2 depicts a bar graph of the mass gain due to carbon deposition (a measure of metal dusting corrosion) on Linde B finished alloys after reaction at 650° C. in 50CO-50$H_2$ gas mixture for 160 hours.

Following the test methods described above, samples of the following alloys were tested: Inconel 601 (prior art), Inconel 693 (prior art), β-NiAl-coated Inconel 601, NiCrAl-coated Inconel 601, and NiCrAl-coated 35/45 alloy. The results of the gravimetric measurements are shown in FIG. 2. FIG. 2 depicts the mass gain due to carbon deposition (a measure of metal dusting corrosion) on Linde B finished alloys after reaction at 650° C. in 50CO-50$H_2$ gas mixture for 160 hours. After metal dusting exposure, the sample surface was covered with carbon, which always accompanies metal dusting corrosion. Significant amount of carbon deposit was measured on the surface of commercially available prior art alloys (Inconel 601 and Inconel 693). By contrast, insignificant or minimal amount of carbon deposit was measured on the coated materials (β-NiAl-coated Inconel 601, NiCrAl-coated Inconel 601, and NiCrAl-coated 35/45 alloy) of the instant invention.

Figure 3:
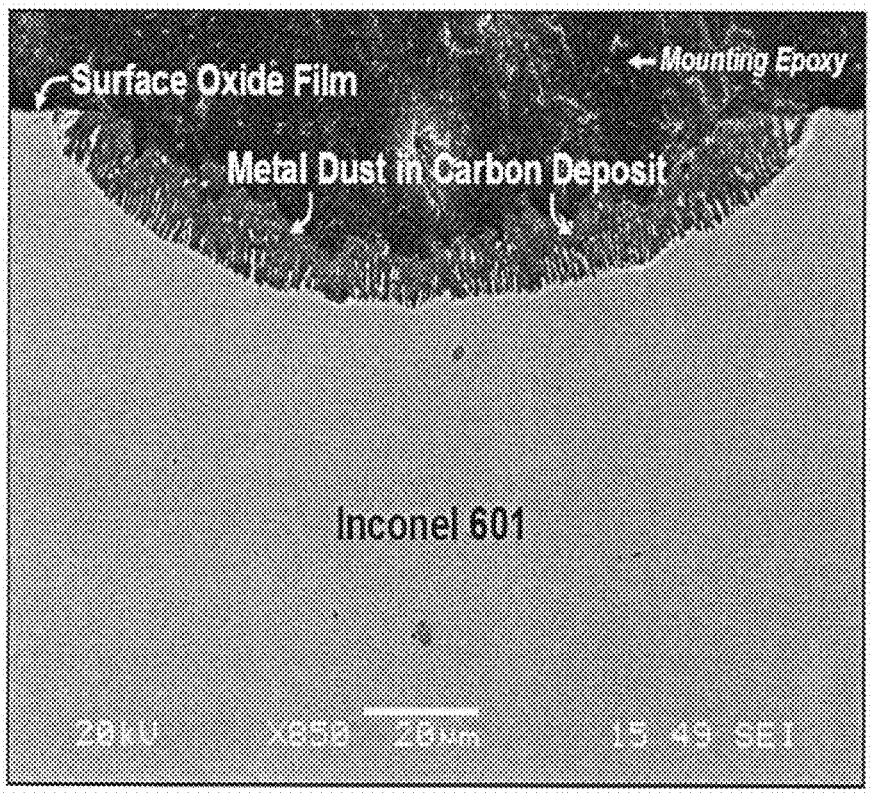
FIG. 3 (PRIOR ART)
FIG. 3 depicts a cross-sectional scanning electron microscopy (SEM) image of the corrosion surface of an uncoated Inconel 601 alloy (prior art) after reaction at 650° C. in 50CO-50$H_2$ gas mixture for 160 hours.
Figure 4:
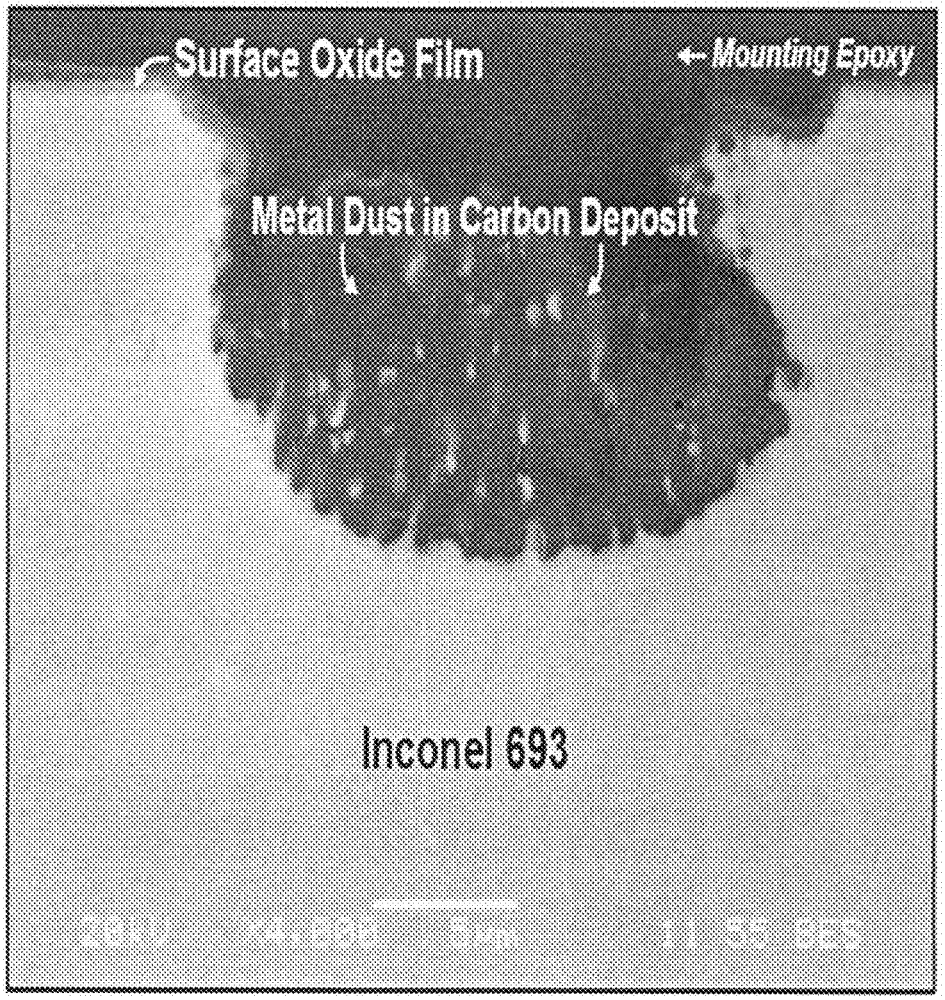
FIG. 4 (PRIOR ART)
FIG. 4 depicts a cross-sectional SEM image of the corrosion surface of an uncoated Inconel 693 alloy (prior art) after reaction at 650° C. in 50CO-50$H_2$ gas mixture for 160 hours.

Susceptibility of metal dusting corrosion was further investigated by a cross-sectional SEM examination of the corrosion surface. A cross-sectional SEM image in FIG. 3 reveals characteristic pit morphology of the prior art Inconel 601 alloy after reaction at 650° C. in 50CO-50$H_2$ gas mixture for 160 hrs. Metal dust in carbon deposit was seen in the pit. The diameter of the pit was about 120 μm and the depth about 20 μm. A cross-sectional SEM image in FIG. 4 reveals characteristic pit morphology of the prior art Inconel 693 alloy after reaction at 650° C. in 50CO-50$H_2$ gas mixture for 160 hrs. Metal dust in carbon deposit was seen in the pit. The diameter of the pit was about 20 μm and the depth was about 8 μm.

Example 2

Figure 5:
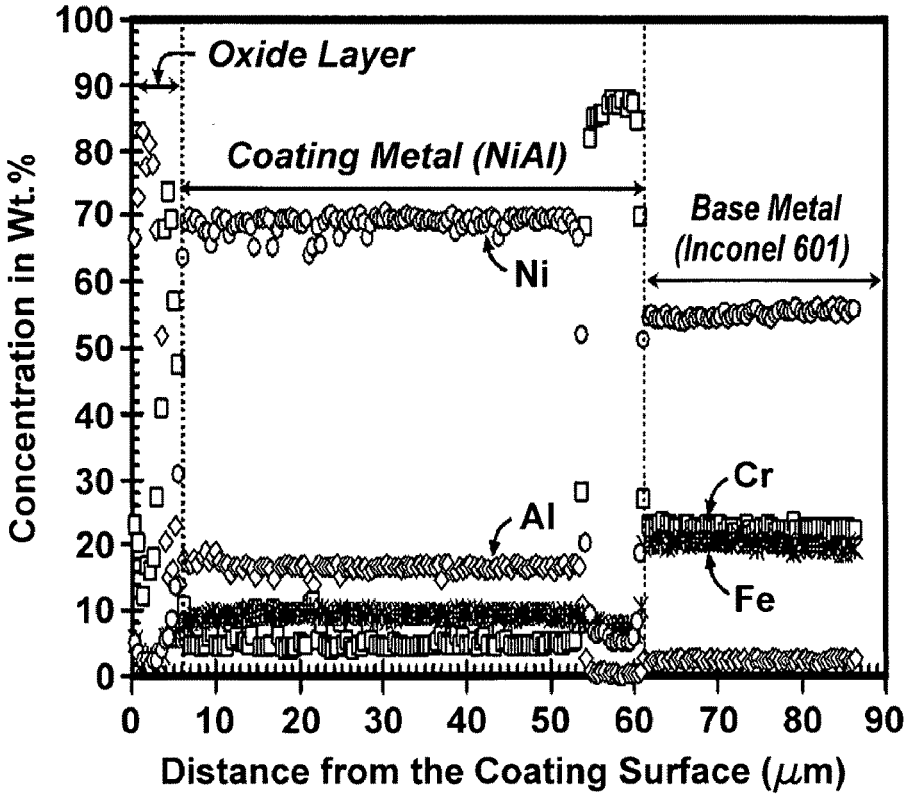
FIG. 5 depicts an EDXS line profile of a high performance NiAl-coated Inconel 601 material of the present invention after testing at 1050° C. in 50CO-50$H_2$ gas mixture for 300 hours.

Following the test method described above, β-NiAl-coated Inconel 601 was tested at 1050° C. in 50CO-50$H_2$ gas mixture for 300 hours. FIG. 5 depicts the EDXS line profile near the coated material surface after testing. The concentration of various elements (Ni, Al, Cr, and Fe) in wt. % was plotted as a function of distance from the coating surface. FIG. 5 depicts the concentration profile of the high performance coated material (PQR) of the instant invention after testing at 1050° C. in 50CO-50$H_2$ gas mixture for 300 hours. The oxide layer, P, consists of alumina. The thickness of the alumina layer is about 5 μm. The coating metal, Q, is β-NiAl, wherein the Al content is about 18 wt. %. The thickness of the β-NiAl layer is about 55 μm. The Fe content in the coating metal, Q, is about 9.8 wt. %. Also about a 6 μm thick Cr-rich layer is observed at the β-NiAl/Inconel 601 interface. The base metal, R, is Inconel 601.

Figure 6:
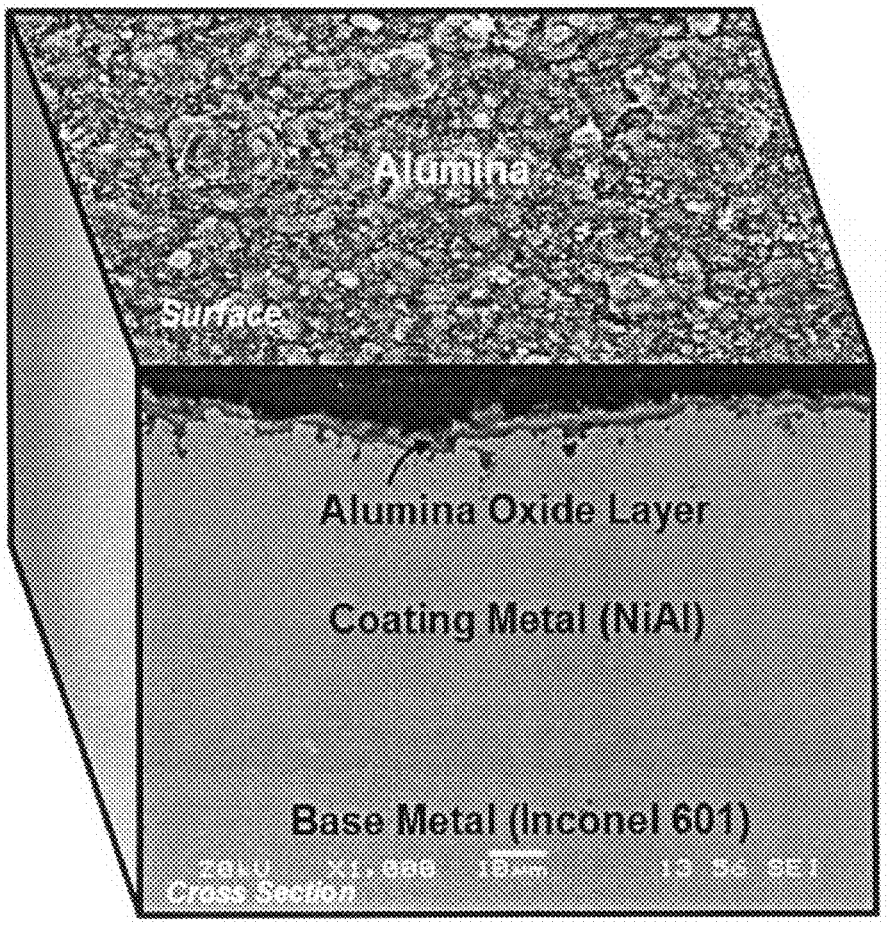
FIG. 6 depicts a surface and cross-sectional SEM image of the high performance NiAl-coated Inconel 601 material of the present invention after testing at 1050° C. in 50CO-50$H_2$ gas mixture for 300 hours.

FIG. 6 is a surface and cross sectional SEM image of the same sample (β-NiAl-coated Inconel 601) after testing at 1050° C. in 50CO-50$H_2$ gas mixture for 300 hours. Illustrated in FIG. 6 are the alumina oxide layer, the coating metal (NiAl) layer, and base metal (Inconel 601).

Example 3

Figure 7:
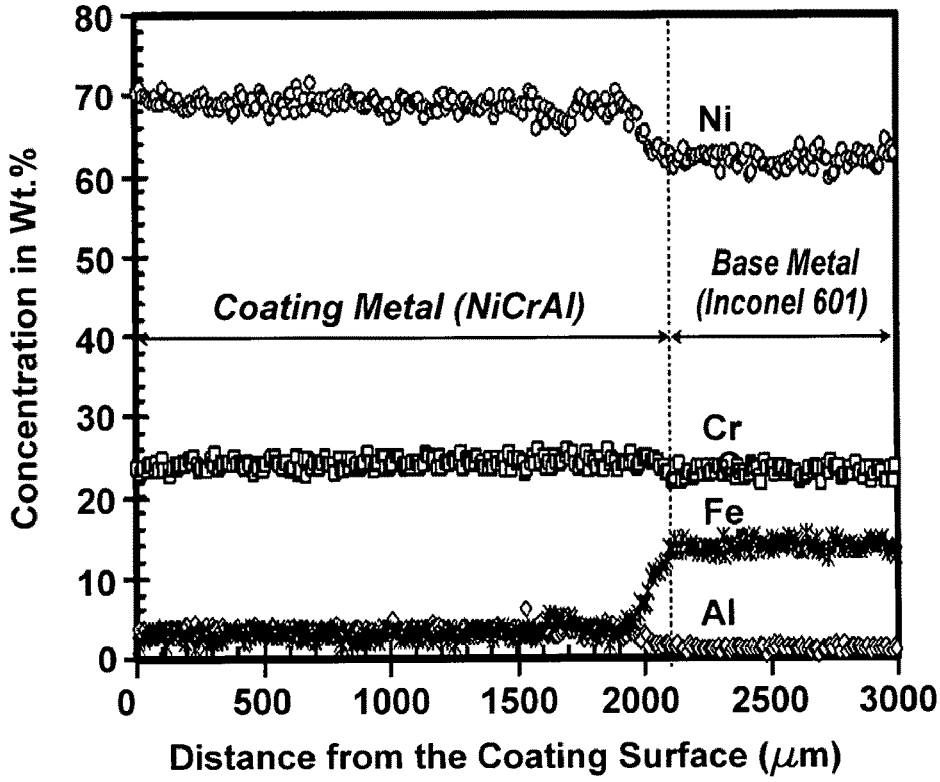
FIG. 7 depicts an EDXS line profile of a high performance NiCrAl-coated Inconel 601 material of the present invention near the coated surface before testing at 1050° C. in 50CO-50$H_2$ gas mixture for 300 hours.
Figure 8:
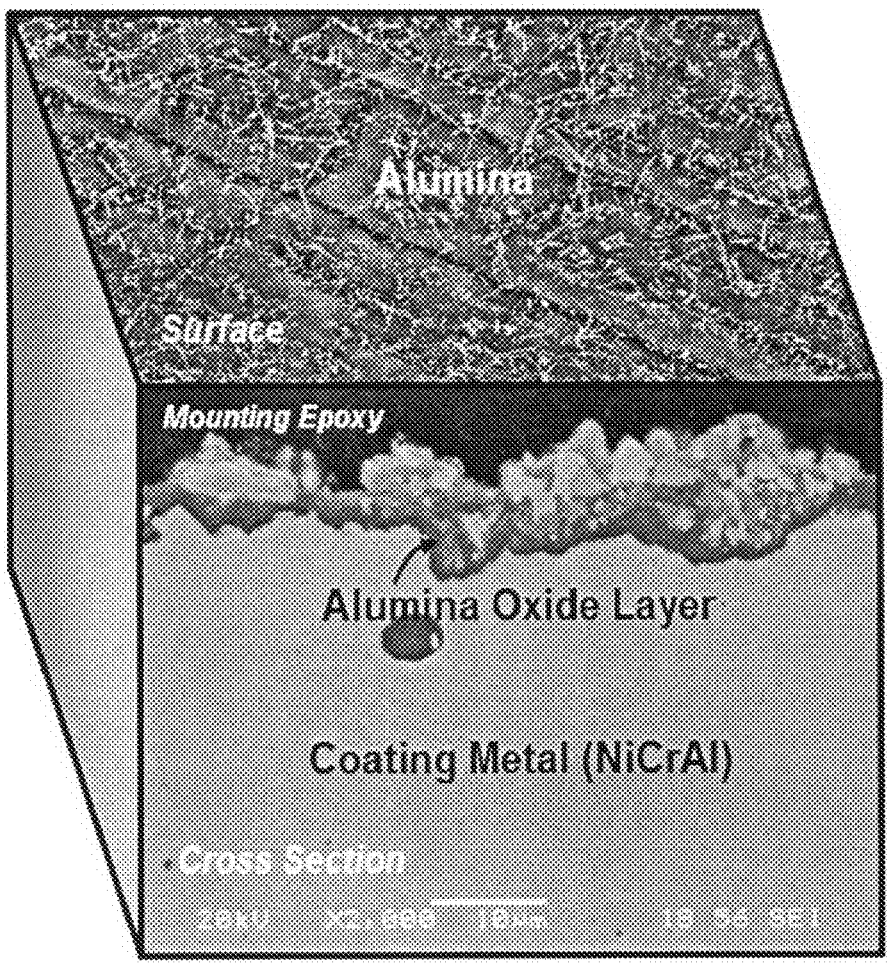
FIG. 8 depicts a surface and cross-sectional image of the high performance NiCrAl-coated Inconel 601 material of the present invention near the coated surface after testing at 1050° C. in 50CO-50$H_2$ gas mixture for 300 hours.

Following the test method described above, NiCrAl-coated Inconel 601 was tested at 1050° C. in 50CO-50$H_2$ gas mixture for 300 hours. FIG. 7 depicts the EDXS line profile near the coated material surface before testing. The concentration of various elements (Ni, Al, Cr, and Fe) in wt. % was plotted as a function of distance from the coating surface. The coating metal, Q, is NiCrAl and comprises about 6 wt. % Al, about 24 wt. % Cr, about 68 wt. % Ni, and about 2 wt. % Fe. The thickness of the coating metal, NiCrAl, is about 2.1 mm. The base metal, R, is Inconel 601. FIG. 8 is a surface and cross sectional SEM image of the same sample after testing at 1050° C. in 50CO-50$H_2$ gas mixture for 300 hours. The oxide layer comprises of about 3 μm thick alumina layer and other oxides comprising chromia and alumina-chromia.

Example 4

Figure 9:
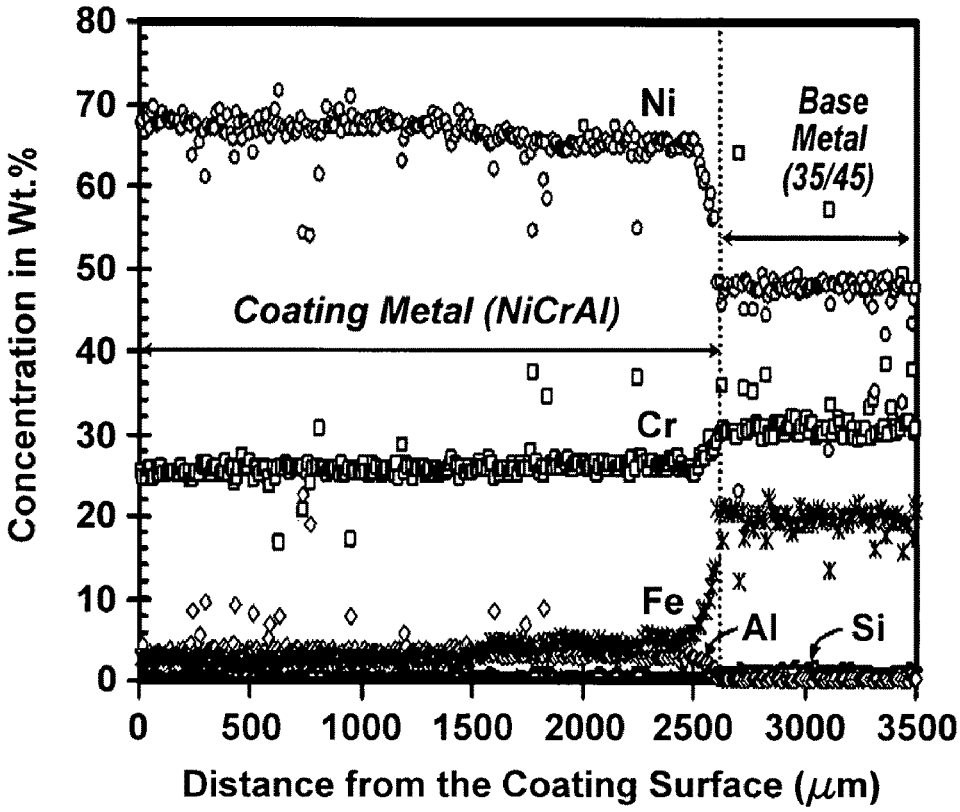
FIG. 9 depicts an EDXS line profile of a high performance NiCrAl-coated 35/45 alloy of the present invention near the coated surface before testing at 1050° C. in 50CO-50$H_2$ gas mixture for 300 hours.
Figure 10:
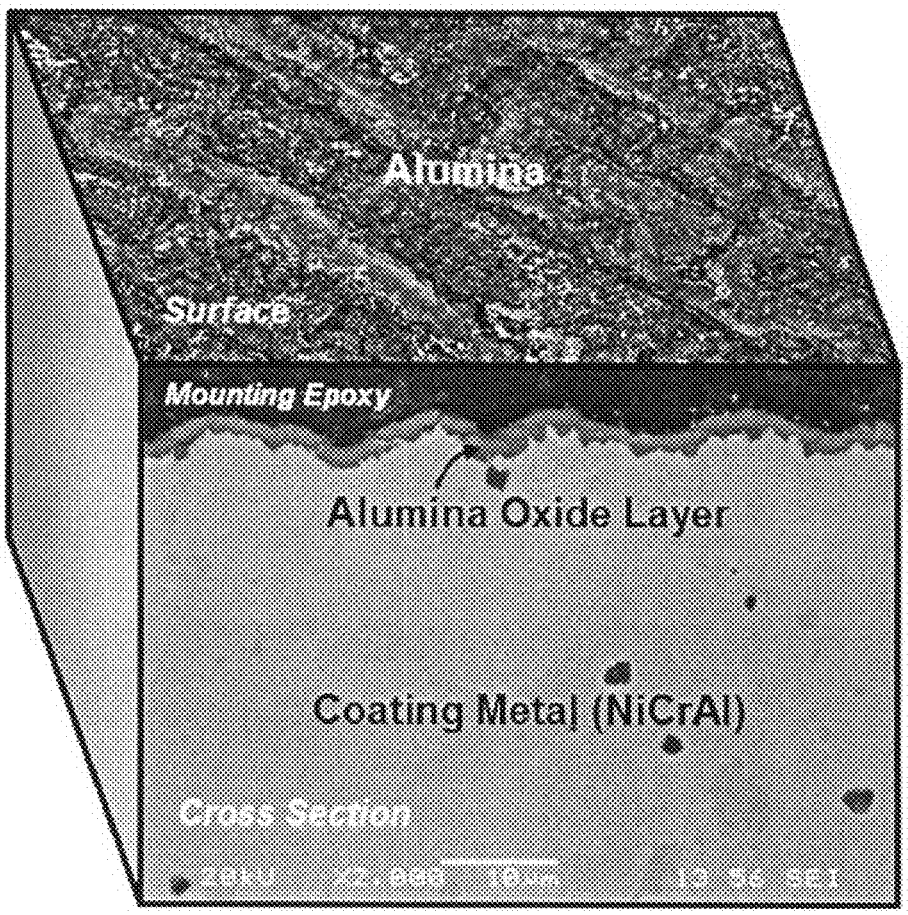
FIG. 10 depicts a surface and cross-sectional image of the high performance NiCrAl-coated 35/45 alloy of the present invention near the coated surface after testing at 1050° C. in 50CO-50$H_2$ gas mixture for 300 hours.

Following the test method described above, NiCrAl-coated 35/45 alloy was tested at 1050° C. in 50CO-50$H_2$ gas mixture for 300 hours. FIG. 9 depicts the EDXS line profile near the coated material surface before testing. The concentration of various elements (Ni, Al, Si, Cr, and Fe) in wt. % was plotted as a function of distance from the coating surface. The coating metal, Q, is NiCrAl and comprises about 5 wt. % Al, about 26 wt. % Cr, about 65 wt. % Ni, about 1 wt. % Si, and about 3 wt. % Fe. The thickness of the coating metal, NiCrAl, is about 2.6 mm. The base metal, R, is the 35/45 alloy. FIG. 10 is a surface and cross sectional SEM images of the same sample after testing at 1050° C. in 50CO-50$H_2$ gas mixture for 300 hours. The oxide layer comprises of about 4 μm thick alumina layer.

Example 5

Comparative Example of High Porosity Coating

Figure 11:
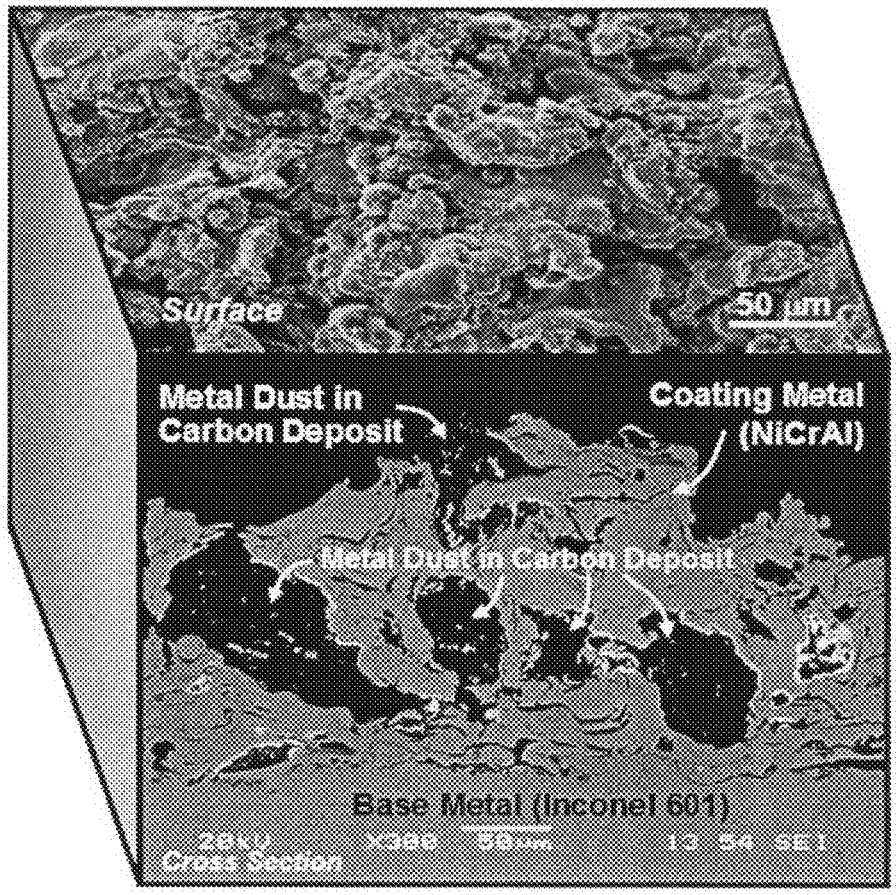
FIG. 11 (PRIOR ART)
FIG. 11 depicts a surface and cross-sectional image of the NiCrAl-coated Inconel 601 material (prior art) near the coated surface after testing at 650° C. in 50CO-50$H_2$ gas mixture for 160 hours.

Following the test method described above, the NiCrAlY-coated Inconel 601 sample was prepared by an air plasma spray, a conventional thermal spray method. The NiCrAlY powder used was Praxair NI-278. The coating metal comprises about 69.2 wt. % Ni, about 23.2 wt. % Cr, about 6.9 wt. % Al, and about 0.7 wt. % Y. The thickness of the coating metal, NiCrAlY, was about 200 μm. The air plasma sprayed NiCrAlY coating contained many pores between solidified droplets and showed poor interface adhesion between the coating metal and the base alloy. The NiCrAlY-coated Inconel 601 was tested at 650° C. in 50CO-50$H_2$ gas mixture for 160 hours. FIG. 11 is a surface and cross sectional SEM image of the same sample after testing. Excessive amount of porosity in the coating metal layer serves as a pathway for corrosive gases in metal dusting environments to transfer to the coating metal and to the base metal surface. The carbon transfer leads to internal carbon precipitation and bulging in the coating metal layer and delamination of the coating metal at the coating/base metal interface. Ni-rich particles were observed in the carbon deposit, which is a characteristic of metal dusting corrosion.

What is claimed is:

1. A high performance coated metal composition resistant to metal dusting corrosion comprising (PQR), wherein P is an oxide layer at the surface of (PQR), Q is a β-NiAl coating metal layer interposed between P and R, and R is a base metal, wherein P comprises alumina, and chromia, Q comprises Ni, Fe, Cr and Al, wherein said β-NiAl coating metal layer Q comprises about 18 wt. % Al, about 9.8 wt. % Fe, between 4.0 and 6.0 wt. % wt % Cr and the balance Ni and R is a Ni-based alloy[s].

2. The coated metal composition of claim 1 wherein said oxide layer P is from about 1 nm to about 100 μm in thickness.

3. The coated metal composition of claim 1 wherein said coating metal layer Q comprises less than about 3 vol. % porosity.

4. The coated metal composition of claim 3 wherein said coating metal layer Q comprises less than about 1 vol. % porosity.

5. The coated metal composition of claim 1 wherein said coating metal layer Q is from about 1 μm to about 300 μm in thickness.

6. The coated metal composition of claim 1 wherein said coated metal composition (PQR) comprises the surfaces of syngas generation process equipment exposed to a carbon supersaturated environment.

7. The coated metal composition of claim 6 wherein said syngas generation process equipment is selected from the group consisting of reactors, gas/gas heat exchangers, and process tubing and piping.

8. A method of preventing metal dusting corrosion of metal surfaces exposed to carbon supersaturated environments comprising: providing metal surfaces exposed to the carbon supersaturated environments with a high performance coated metal composition (PQR), wherein P is an oxide layer at the surface of (PQR), Q is a β-NiAl coating metal layer interposed between P and R, and R is a base metal, wherein P comprises alumina, and chromia, Q comprises Ni, Fe, Cr and Al, wherein said β-NiAl coating metal layer Q comprises about 18 wt. % Al, about 9.8 wt. % Fe, between 4.0 and 6.0 wt. % wt % Cr and the balance Ni and R is a Ni-based alloy[s], and wherein said providing step includes post-annealing or laser melting said high performance coated metal composition (PQR) to form said β-NiAl coating metal layer Q.

9. The method of claim 8 wherein said oxide layer P is from about 1 nm to about 100 μm in thickness.

10. The method of claim 8 wherein said oxide layer P is formed in part in-situ during use or prior to use by exposing said coated metal surfaces to a carbon supersaturated and low oxygen partial pressure environment or a controlled low oxygen partial pressure environment.

11. The method of claim 10 wherein said carbon supersaturated and low oxygen partial pressure environment is a gaseous 50CO:50$H_2$ mixture at a temperature from about 350° C. to about 1200° C. for an exposure time of from about 1 hour to about 500 hours.

12. The method of claim 11 wherein said carbon supersaturated and low oxygen partial pressure environment further comprises a gas selected from the group consisting of $CH_4$, $NH_3$, $N_2$, $O_2$, He, Ar, hydrocarbons, and mixtures thereof

13. The method of claim 10 wherein said controlled low oxygen partial pressure environment is a gaseous $H_2O$:$H_2$ mixture or a gaseous $CO_2$:CO mixture at a temperature from about 350° C. to about 1200° C. for an exposure time of from about 1 hour to about 500 hours.

14. The method of claim 13 wherein said controlled low oxygen partial pressure environment further comprises a gas selected from the group consisting of $CH_4$, $NH_3$, $N_2$, $O_2$, He, Ar, hydrocarbons, and mixtures thereof.

15. The method of claim 8 wherein said coating metal layer Q comprises less than about 3 vol. % porosity.

16. The method of claim 15 wherein said coating metal layer Q comprises less than about 1 vol. % porosity.

17. The method of claim 8 wherein said coating metal layer Q is from about 1 μm to about 300 μm in thickness.

18. The method of claim 17 wherein said step of providing metal surfaces exposed to the carbon supersaturated environments with a high performance coated metal composition (PQR) is selected from the group consisting of:

a) constructing said metal surface of said high performance coated metal composition (PQR), b) coextruding said metal layer Q on said base metal layer R, c) coating said metal layer Q on said base metal layer R, and d) a combination of steps a), b), and c).

19. The method of claim 18, wherein said coating step c) is selected from the group consisting of CVD, MOCVD, PVD, slurry coating and pack cementation.

20. The method of claim 8 wherein said step of providing metal surfaces exposed to the carbon supersaturated environments with a high performance coated metal composition (PQR) is selected from the group consisting of:

a) constructing said metal surface of said high performance coated metal composition (PQR), b) coextruding said metal layer Q on said base metal layer R, c) coating said metal layer Q on said base metal layer R, and d) a combination of steps a), b), and c).

21. The method of claim 20, wherein said coating step c) is by powder plasma welding.

22. The method of claim 8 wherein said coated metal composition (PQR) comprises the surfaces of syngas generation process equipment exposed to a carbon supersaturated environment.

23. The method of claim 22 wherein said syngas generation process equipment is selected from the group consisting of reactors, gas/gas heat exchangers, and process tubing and piping.

* * * * *